United States Patent [19]

Dickinson

[11] Patent Number: 4,624,775

[45] Date of Patent: Nov. 25, 1986

[54] PROCESS FOR THE PRODUCTION OF PREMIUM COKE FROM PYROLYSIS TAR

[75] Inventor: Eric M. Dickinson, Bay Village, Ohio

[73] Assignee: Union Carbide Corporation, Danbury, Conn.

[21] Appl. No.: 663,495

[22] Filed: Oct. 22, 1984

[51] Int. Cl.[4] ..... C10G 9/14

[52] U.S. Cl. ..... 208/131

[58] Field of Search ..... 208/131, 44, 23

[56] References Cited

U.S. PATENT DOCUMENTS

| | | | |
|---|---|---|---|
| 3,116,231 | 12/1963 | Adee | 208/131 |
| 3,375,188 | 3/1968 | Bloomer | 208/131 |
| 3,547,804 | 12/1970 | Noguchi et al. | 208/131 X |
| 3,563,884 | 2/1971 | Bloomer | 208/131 |
| 3,617,515 | 11/1971 | Bloomer | 208/131 |
| 3,799,865 | 3/1974 | Suetsugu et al. | 208/44 X |
| 3,817,853 | 6/1974 | Folkins | 208/131 |
| 4,066,532 | 1/1978 | Garcia | 208/131 |
| 4,075,084 | 2/1978 | Skripek et al. | 208/131 X |
| 4,111,794 | 9/1978 | Pietzka et al. | 208/131 |
| 4,127,472 | 11/1978 | Migitaka et al. | 208/131 X |
| 4,292,170 | 9/1981 | Simone | 208/131 |

*Primary Examiner*—Glenn Caldarola

*Attorney, Agent, or Firm*—Cornelius F. O'Brien

[57] ABSTRACT

Coking a mixture comprised of (a) between about 60 and about 90 weight percent pyrolysis tar and (b) between about 10 and about 40 weight percent coal tar distillate, preferably by delayed coking, produces a premium coke.

7 Claims, No Drawings

PROCESS FOR THE PRODUCTION OF PREMIUM COKE FROM PYROLYSIS TAR

FIELD OF THE INVENTION

This invention relates to a process for the production of a premium coke comprising coking, preferably by delayed coking, a mixture comprised of (a) between about 60 and about 90 weight percent pyrolysis tar and (b) between about 10 and about 40 weight percent coal tar distillate.

BACKGROUND OF THE INVENTION

The use of pyrolysis tars as a feedstock to make a premium coke suitable for the production of graphite electrodes has long been a goal of the electrode industry. This desire to employ pyrolysis tars, which are the residue by-product of steam-cracking of naphtha or gas oil in the production of ethylene, stems from the fact that pyrolysis tars are in plentiful supply, are low in sulfur content and possess a high coke yield.

In commercial practice, the conversion of hydrocarbon tars to coke is primarily accomplished by the process of delayed coking. The process of delayed coking has long been one of the standard processes for converting low value residual liquid hydrocarbonaceous materials into more desirable products. Essentially this process comprises rapidly heating the feedstock to the desired coking temperature by passing it through a heated conduit before entering it into an insulated, non-heated coke drum where the coking reaction is completed. The coking process is complete when the formation of coke has progressed to the desired extent. Delayed coking is detailed by Charles L. Mantell, *Carbon and Graphite Handbook*, pp 149–151, Wiley-Interscience (1968) and R. DeBiase, J. D. Elliott and T. E. Hartnett, "Delayed Coking Process Update", Symposium on Petroleum Derived Carbons, Preprints, American Chemical Society, St. Louis Meeting, Apr. 8–13, 1984, pp 412–423.

Unfortunately, however, a major problem associated with the delayed coking of pyrolysis tar is that pyrolysis tars generally contain a large amount of highly reactive molecules. Thus, as has been noted in the prior art (see for example, U.S. Pat. No. 3,817,853), when pyrolysis tars are heated to the necessary temperatures for delayed coking operations coke is prematurely deposited in the heater tubes due to the highly reactive nature of the tar. The extent of this coke formation may be so great that the heating tubes may become plugged in a very short operating time thereby necessitating a shutdown and cleaning of the system.

While U.S. Pat. No. 3,547,804 discloses admixing the pyrolysis tar with a low-boiling distillate to sweep the tar through the heating tubes without premature coke deposition, as noted by U.S. Pat. No. 3,817,853, even when special precautions are taken to avoid premature coke deposition with the highly reactive pyrolysis tars a premium coke (i.e. a coke producing a graphite having a coefficient of thermal expansion, "CTE", of not greater than $0.55\times10^{-6}$ inch per inch per degree centigrade) may not be produced.

To improve the quality of the coke produced by the delayed coking of pyrolysis tar it has been disclosed in the prior art to hydrogen treat the pyrolysis tar prior to subjecting it to delayed coking. For example, U.S. Pat. No. 3,817,853 discloses pretreating pyrolysis tar by contacting it with hydrogen at a temperature from about 250° to about 800° F. under conditions sufficient to effect a consumption of hydrogen of from 100 to about 2000 standard cubic feet per barrel of pyrolysis tar.

However, while such hydrogen upgrading treatment will produce pyrolysis tars which will yield premium cokes, such treatment is costly, requires a separate hydrogenating unit, and leads to loss in coke yield. Moreover, a potential safety hazard exists in the employment of hydrogen. It would therefore be desirable to have a process for producing premium coke from pyrolysis tar which process does not involve an expensive hydrogenation step with the resultant loss in coke yield.

It is therefore an object of this invention to provide an economical process for the production of premium coke from pyrolysis tar.

It is a further object of this invention to provide a process for the production of premium coke from pyrolysis tar wherein the coke yield of such tar is not adversely affected as in hydrogen pretreatments.

The above and other objects of this invention will become more apparent from the following description and examples.

DESCRIPTION OF THE INVENTION

This invention relates to a process for producing premium coke from pyrolysis tar comprising the steps:

(a) blending between about 60 and about 90 weight percent, preferably between about 70 and 85 weight percent, pyrolysis tar and between about 10 and about 40 weight percent, preferably between about 15 and about 30 weight percent, coal tar distillate to form a mixture; and (b) coking said mixture, preferably by delayed coking.

The process of coking involves the heat treatment of a carbonaceous feedstock until the volatile constituents have distilled off or otherwise reacted so that coke is left as a residue.

Pyrolysis tars are the heavy by-products produced in the high temperature steam cracking of naphtha condensates and gas oils as well as of low-boiling hydrocarbons such as ethane and propane to form olefins. As is employed herein, the term "pyrolysis tars" includes materials which have been referred to as steam cracker residues, ethylene tars and pyrolysis fuel oils in the prior art.

As is employed herein the term "coal tar distillate" refers to materials having an initial boiling point of above about 300° C. These distillates should preferably have at least half their molecules comprised of at least two or more condensed aromatic rings. Preferably, such distillate should comprise less than about 1 weight percent oxygen. Illustrative of the coal tar distillates which may be employed are heavy creosote oil and anthracene oil.

While the use of a coal tar distillate, such as a heavy creosote oil, will contribute a low CTE coke to the coke derived from the blend, the CTE exhibited by the coke produced by the process of this invention indicates an effect beyond the expected contribution of the coal tar distillate alone.

Although not wishing to be held to a particular theory, it is hypothesized that the beneficial interaction of the coal tar distillate with the pyrolysis tar stems from the coal tar distillate's containing a substantial proportion of molecules which can readily undergo hydrogenation/dehydrogenation reactions, i.e., act as "hydrogen shuttlers". It is speculated that the 2–5 ring polynuclear aromatics in the coal tar distillate are partially hydrogenated by hydrogen from the pyrolysis tar (a strong H-donor) at temperatures below about 330° C., i.e., prior to coking. The hydroaromatic compounds produced are excellent hydrogen donors. As the temperature is raised the pryolysis tar molecules start to crack and the resultant radical species could abstract hydrogen from the hydrogenated high-boiling coal tar distillate molecules to form molecules which are more stable to polymerization. Apparently the overall effect is to slow down the polymerization rate of the pyrolysis tar, allowing more time for molecular alignment during mesophase and coke formation and resulting in a more highly ordered coke exhibiting a lower CTE.

The process of the present invention is typically conducted as follows. A first feed, comprising pyrolysis tar, and a second feed, comprising coal tar distillate are blended in appropriate proportions to form a mixture.

When delayed coking is employed, the coal tar distillate/pyrolysis tar mixture is typically preheated to between about 460° C. and about 500° C., preferably between about 470° C. and about 490° C., by passing such mixture through a heated conduit. The heated mixture is then introduced into the coke drum. Because of the interaction of the coal tar distillate when the pyrolysis tar, it has been found that the problem of premature coking deposition on the heating tube is substantially reduced or eliminated. The heated mixture is allowed to react in the coke drum until coking is complete. This generally occurs after about 24 hours, although longer or shorter time periods may be required depending upon batch size and other similar factors.

When batch coking or similar processes are employed, the mixture is typically heated at about 50° C./hour to about 650° C. and held at this temperature for about 5 hours at a pressure of about 100 psig. However, higher or lower temperatures and/or pressures may be employed depending upon factors such as reaction batch size and the like. One skilled in the art could determine by routine experimentation the optimum reaction conditions for such batch-type coking processes.

After the coking process is complete, the coke is typically subjected to calcination to a temperature of about 1400° C. It is then ready for processing into graphite. The coke produced by the method of this invention typically produces a graphite exhibiting a CTE of less than about $0.55\times10^{-6}$ per degree Celsius measured in the temperature range of 30° C. to 100° C. and is thus a premium coke.

EXAMPLES

The following Examples are intended to further illustrate the invention and are not intended to limit the scope of the invention in any manner.

EXAMPLE 1

A blend comprised of (a) 80 weight percent of pyrolysis tar, produced by steam-cracking of naphtha, and (b) 20 weight percent of a high boiling coal tar distillate was prepared by mixing at 150° C. for about one hour.

Analysis revealed that the pyrolysis tar employed in this Example possessed the properties detailed below:

| | |
|---|---|
| Density, 15° C., /cc | 1.08 |
| Conradson Carbon % | 12.0 |
| Carbon % | 92.7 |
| Hydrogen % | 7.3 |
| Toluene Insolubles % less than | 0.1 |
| Aromatic Hydrogen % | 50 |
| Initial Boiling Point | 180° C. |

The high boiling coal tar distillate of this example possessed the following properties:

| | |
|---|---|
| Density 15° C., g/cc | 1.19 |
| Conradson Carbon % | 2.2 |
| Carbon % | 91.0 |
| Hydrogen % | 5.3 |
| Sulfur % | 0.7 |
| Oxygen % | 0.9 |
| Quinoline Insolubles % | 0.1 |
| Aromatic Hydrogen % | 80 |
| ASTM D-246 Distillation | 4% up to 355° C. |

The blend was batch coked in the laboratory in a pressure vessel at 100 psig by heating at 50° C./hour to 650° C. and holding at this temperature for 5 hours. The yield of raw coke was 30%. The raw coke was calcined to 1400° C. in an inert atmosphere. The calcined coke was crushed to a flour, 55% of which passed through a 200 Tyler mesh screen. The flour was mixed with coal tar binder pitch and extruded into 19-mm diameter green rods. The rods were baked at 40° C./hour to 1000° C. and graphatized in a graphite tube furnace to 3000° C.

The coefficient of thermal expansion ("CTE") of the graphite rods measured in the range 30°–100° C. was $0.53\times10^{-6}$/°C. When the pyrolysis tar was coked by itself under these conditions, such coke yielded graphite of CTE $0.74\times10^{-6}$/°C. The results of these coking experiments are summarized in Table I.

TABLE I

Batch Coking of Pyrolysis Tar and Coal Tar Distillate

| | 1400° C. Calcined Coke | |
|---|---|---|
| Feedstock | Yield % | Graphite CTE $\times 10^{-6}$/°C. |
| Pyrolysis Tar | 24.7 | 0.74 |
| 80/20 Pyrolysis Tar/Coal Tar Distillate | 28.1 | 0.53 |

The above data indicate that graphite derived from the coke produced by the process of this invention exhibits a CTE which is substantially below that exhibited by graphite produced from pyrolysis tar coke alone. Moreover, examination of the above data reveals that the process of this invention produces an increased yield of coke relative to processes comprising coking pyrolysis tar alone.

EXAMPLE 2

A blend composed of (a) 70 weight percent of pyrolysis tar, produced by steam-cracking of a mixture of naphtha and gas oil, and (b) 30 weight percent of a coal tar distillate, was prepared by stirring at 150° C. for about 1 hour.

The pyrolysis tar employed in this example possessed the properties detailed below.

| | |
|---|---|
| Density 15° C., g/cc | 1.10 |
| Conradson Carbon % | 18.5 |
| Carbon % | 92.7 |
| Hydrogen % | 7.4 |
| Sulfur % | 0.4 |
| Toluene Insolubles % | 0.1 |
| Aromatic Hydrogen % | 40 |
| Molecular Weight | 282 |
| Initial Boiling Point | 212° C. |

The coal tar distillate was the same as that used in Example 1. The blend was batch coked in the laboratory at 100 psig as in Example 1 and the raw coke yield was 37%. The raw coke was calcined at 1400° C. and processed into graphite rods as described in Example 1. The CTE of the graphite rods measured over the range 30°-100° C. was $0.34\times10^{-6}$/°C. When the pyrolysis tar was coked by itself under these conditions it gave graphite of CTE $0.47\times10^{-6}$/°C. The results of these coking experiments are summarized in Table II.

TABLE II

Batch Coking of Pyrolysis Tar and Coal Tar Distillate

| | 1400° C. Calcined Coke | |
|---|---|---|
| Feedstock | Yield % | Graphite CTE $\times 10^{-6}$/°C. |
| Pyrolysis Tar | 33.6 | 0.47 |
| 70/30 Pyrolysis Tar/Coal Tar Distillate | 35.4 | 0.34 |

The above data indicate that graphite derived from the coke produced by the process of this invention exhibits a CTE which is substantially below that exhibited by graphite produced from pyrolysis tar coke alone. Moreover, examination of the above data reveals that the process of this invention produces an increased yield of coke relative to processes comprising coking pyrolysis tar alone.

EXAMPLE 3

A blend comprising 80 weight percent of a third pyrolysis tar, produced by steam-cracking of a mixture of naphtha and gas oil, and 20 weight percent of the same coal tar distillate employed in Example 1 was prepared.

Such third pyrolysis tar possessed the following properties:

| | |
|---|---|
| Density 15° C., g/cc | 1.11 |
| Conradson Carbon % | 19.5 |
| Carbon % | 91.3 |
| Hydrogen % | 7.3 |
| Toluene Insolubles % | 0.05 |

-continued

| | |
|---|---|
| Aromatic Hydrogen % | 41.1 |
| Initial Boiling Point | 200° C. |

The blend was coked in a pilot delayed coker. The coking furnace outlet temperature was 490° C., the pressure was 90 psig and the combined feed ratio (defined as the ratio of fresh feed+recycle to fresh feed) was 1.62. The raw coke from this run was calcined at 1400° C. and made into 19-mm diameter graphite rods according to the procedure described in Example 1. The graphite CTE, measured at 30°-100° C. was $0.50\times10^{-6}$/°C. When the pyrolysis tar of this example was coked alone, under similar conditions and the coke was made into graphite rods, a CTE of about $0.68\times10^{-6}$/°C. was obtained. Thus, the addition of the coal tar feedstock to pyrolysis tar upgraded the pyrolysis tar such that it produced a premium coke.

While the preferred embodiments of this invention have been described in detail above, it will be understood that changes and modifications of the invention described herein may be made without departing from the spirit and scope of the invention.

What is claimed is:

1. A process for producing premium coke comprising the steps:

(a) blending between about 60 and about 90 weight percent pyrolysis tar and between about 10 and about 40 weight percent coal tar distillate to form a mixture; and (b) coking said mixture.

2. The process of claim 1 wherein between about 70 and about 85 weight percent pyrolysis tar and between about 15 and about 30 weight percent coal tar distillate are mixed in step (a).

3. The process of claim 1 wherein the coal tar distillate mixed in step (a) comprises at least one member of the group consisting of heavy creosote oil and anthracene oil.

4. The process of claim 1 wherein the coking in step (b) is accomplished by delayed coking of the mixture, said delayed coking comprising the steps of:

(i) preheating the mixture;

(ii) introducing the preheated mixture into a coking drum; and (iii) reacting the mixture in the coking drum until coking is complete.

5. The process of claim 4 wherein the mixture is preheated to between about 460° C. and about 500° C. in step (i).

6. The process of claim 4 wherein the blend is preheated to between about 470° C. and about 490° C. in step (i).

7. The process of claim 1 wherein the coal tar distillate comprises less than about 1 weight percent oxygen.

* * * * *